US008118093B2

(12) United States Patent
Hassell et al.

(10) Patent No.: US 8,118,093 B2
(45) Date of Patent: Feb. 21, 2012

(54) THREADED RETENTION DEVICE FOR DOWNHOLE TRANSMISSION LINES

(75) Inventors: Trent Hassell, Pleasant Grove, UT (US); Prabesh Lohani, Provo, UT (US)

(73) Assignee: IntelliServ, LLC, Houston, TX (US)

( * ) Notice: Subject to any disclaimer, the term of this patent is extended or adjusted under 35 U.S.C. 154(b) by 155 days.

(21) Appl. No.: 12/264,340

(22) Filed: Nov. 4, 2008

(65) Prior Publication Data

US 2010/0111592 A1 May 6, 2010

(51) Int. Cl.
*E21B 17/02* (2006.01)
*E21B 47/12* (2006.01)

(52) U.S. Cl. ..... 166/242.6; 166/380

(58) Field of Classification Search ..... 166/380, 166/242.6; 403/24; 340/855.1
See application file for complete search history.

(56) References Cited

U.S. PATENT DOCUMENTS 3,079,793 A * 3/1963 Le Bus et al. ..... 73/152.26
3,238,500 A * 3/1966 McElroy et al. ..... 340/442
3,472,076 A * 10/1969 Brannon, Jr. et al. ..... 73/382 R
5,531,545 A * 7/1996 Seegmiller et al. ..... 405/259.4
5,850,879 A * 12/1998 Smith ..... 166/250.01
6,086,339 A * 7/2000 Jeffrey ..... 417/415
6,209,632 B1 * 4/2001 Holbert et al. ..... 166/65.1
6,241,022 B1 * 6/2001 Mailand et al. ..... 166/380
6,310,559 B1 * 10/2001 Laborde et al. ..... 340/853.2
6,530,433 B2 * 3/2003 Smith et al. ..... 166/387
6,843,119 B2 * 1/2005 Patey et al. ..... 73/152.18
7,452,007 B2 * 11/2008 Hashem et al. ..... 285/333
7,547,077 B2 * 6/2009 Melberg et al. ..... 301/108.1
7,683,802 B2 * 3/2010 Madhavan et al. ..... 340/854.8
2003/0213598 A1 * 11/2003 Hughes ..... 166/380
2004/0134652 A1 * 7/2004 Holbert et al. ..... 166/66
2006/0124291 A1 * 6/2006 Chau ..... 166/65.1
2009/0139711 A1 * 6/2009 Hall et al. ..... 166/242.6

* cited by examiner

*Primary Examiner* — Brad Harcourt
(74) *Attorney, Agent, or Firm* — Adenike Adebiyi; Carol E. Smith

(57) ABSTRACT

An apparatus for retaining and tensioning an end of a transmission line includes a nut element having internal threads configured to engage an externally threaded transmission line, such as an externally threaded coaxial cable, thereby retaining an end of the transmission line. The internal threads may form a passageway extending from a first end of the nut element to a second end of the nut element. This passageway may allow a transmission line to pass through the nut element. A socket may be incorporated into one end of the nut element to enable a tool to apply torque thereto. A corresponding method is also disclosed.

23 Claims, 6 Drawing Sheets

THREADED RETENTION DEVICE FOR DOWNHOLE TRANSMISSION LINES

BACKGROUND

1. Field of the Invention

This invention relates to downhole drilling, and more particularly to apparatus and methods for retaining and tensioning transmission lines in downhole tools.

2. Description of the Related Art

For half a century, the oil and gas industry has sought to develop downhole telemetry systems that enable high-definition formation evaluation and borehole navigation while drilling in real time. The ability to transmit large amounts of sub-surface data to the surface has the potential to significantly decrease drilling costs by enabling operators to more accurately direct the drill string to hydrocarbon deposits. Such information may also improve safety and reduce the environmental impacts of drilling. This technology may also be desirable to take advantage of numerous advances in the design of tools and techniques for oil and gas exploration, and may be used to provide real-time access to data such as temperature, pressure, inclination, salinity, and the like, while drilling.

In order to transmit data at high speeds along a drill string, various approaches have been attempted or suggested. One approach that is currently being implemented and achieving commercial success is to incorporate data transmission lines, or wires, into drill string components. These data transmission lines bi-directionally transmit data along the drill string. In certain cases, drill string components may be modified to include high-speed, high-strength data cable running through their central bores. In certain cases, this approach may require placing repeaters or amplifiers at selected intervals along the drill string to amplify or boost the signal as it travels along the transmission lines.

In order to implement a "wired" drill string, apparatus and methods are needed to route transmission lines or wires, such as coaxial cable, along or through the central bore of drill string components. Ideally, such apparatus and methods would be able to retain the transmission lines under tension. This will minimize movement of the transmission line within the central bore and minimize interference with tools or debris moving therethrough. Further needed are apparatus and methods to seal and isolate the transmission lines from drilling fluids passing through the central bore of the drill string. Yet further needed are apparatus and methods to quickly install the transmission lines in downhole tools, while minimizing the need for expensive equipment or highly trained personnel.

SUMMARY

The present invention provides apparatus and methods for retaining and tensioning transmission lines routed through or along downhole tools. The features and advantages of the present invention will become more fully apparent from the following description and appended claims, or may be learned by practice of the invention as set forth hereinafter.

In a first aspect of the invention, an apparatus for retaining and tensioning an end of a transmission line includes a nut element having internal threads configured to engage an externally threaded transmission line, such as an externally threaded coaxial cable, thereby retaining an end of the transmission line. The internal threads may form a passageway extending from a first end of the nut element to a second end of the nut element. This passageway may allow a transmission line to pass through the nut element. A socket may be incorporated into one end of the nut element to enable a tool to apply torque thereto.

In certain aspects, an outer surface of the nut element is substantially cylindrical, allowing the nut element to slide within a cylindrical borehole formed in the downhole tool. Similarly, an outer surface of the externally threaded transmission line may also be substantially cylindrical. In selected embodiments, the outer diameter of the nut element is larger than the outer diameter of the externally threaded transmission line. This will allow the nut element to abut against a counterbore feature in the downhole tool, thereby retaining and maintaining tension in the transmission line.

In selected aspects, an elastomeric seal member may be inserted into the passageway of the nut element. This may seal the joint between the externally threaded transmission line and the nut element and also create a seal between the outside diameter of the transmission line and the inside diameter of the tubing. In some aspects of the invention, the transmission line is sheathed or housed within tubing providing "armor" for the transmission line. A screw piece may be provided to thread into the internal threads and compress the elastomeric seal member, thereby providing a high pressure and high temperature air- and/or water-tight seal. In selected embodiments, a socket is incorporated into the screw piece to enable a tool to apply torque thereto.

In another aspect, an apparatus in accordance with the invention may include a downhole tool and a transmission line extending through a central bore of the downhole tool. The transmission line may include external threads on an end thereof. A retention device may be provided to secure the transmission line at or near an end of the downhole tool. This retention device may include a nut element having internal threads configured to engage the external threads of the transmission line and abut against a feature of the downhole tool, thereby retaining the end of the transmission line. The internal threads may form a passageway extending from a first end of the nut element to a second end of the nut element. This passageway will enable a transmission line to pass through the nut element.

In yet another aspect, a method for securing a transmission line proximate an end of a downhole tool may include routing a transmission line through a central bore of a downhole tool. The method may further include securing the transmission line at or near an end of the downhole tool. In certain embodiments, securing may include threading an internally threaded nut element over the external threads of the transmission line. The internal threads may form a passageway extending from a first end to a second end of the nut element, thereby allowing a transmission line to pass through the nut element.

In selected aspects, the method may further include applying torque to a socket incorporated into one of the first and second ends of the nut element. This allows the nut element to thread onto the external threads of the transmission line, thereby retaining the transmission line and potentially increasing tension in the transmission line. The method may further include inserting an elastomeric seal member into the passageway to seal the joint between the transmission line and the nut element. A screw piece may be screwed into the internal threads of the nut element to compress the elastomeric seal member, thereby enhancing the seal.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may be easily made without departing from the essential characteristics of the invention, as described in connection with the Figures. Thus, the following description of the Figures is intended only by way of example, and simply illustrates certain selected embodiments consistent with the invention as claimed herein.

Figure 1:
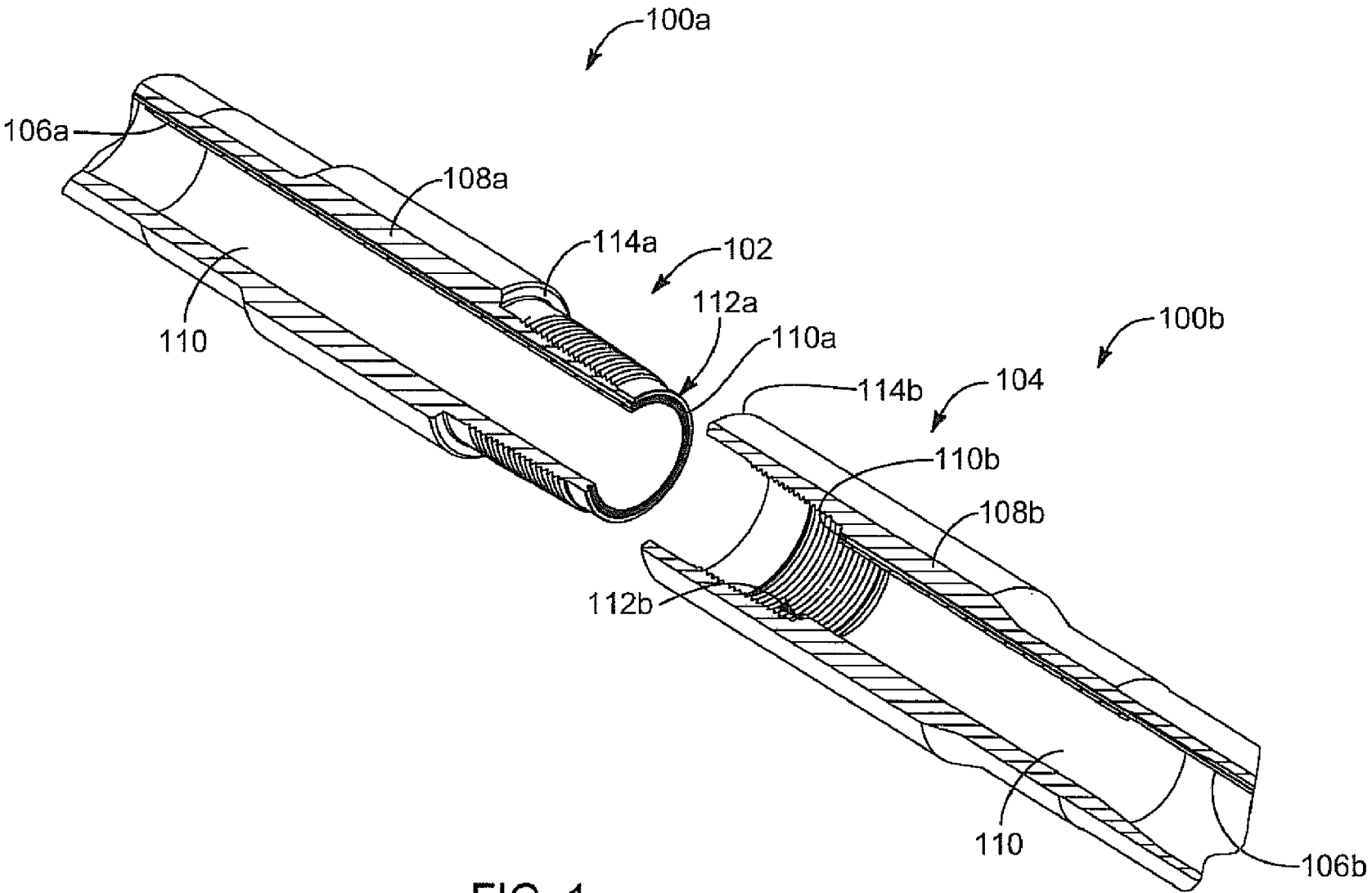
FIG. 1 is a cutaway cross-sectional perspective view of two "wired" downhole tools.

Referring to FIG. 1, one example of a pair of "wired" downhole tools 100*a*, 100*b*, configured to transmit data signals along a drill string, is illustrated. In this example, the pin end 102 of a first downhole tool 100*a* (e.g., a first section of drill pipe 100*a*) is configured to thread into the box end 104 of a second downhole tool 100*b* (e.g., a second section of drill pipe 100*b*). A transmission line 106*a*, 106*b* may be incorporated into the first and second downhole tools 100*a*, 100*b* to transmit data signals therealong. In certain embodiments, the transmission lines 106*a*, 106*b* may be incorporated into the walls 108*a*, 108*b* of the downhole tools 100*a*, 100*b* at or near the pin end 102 and box end 104, since the wall thickness in these areas may be greater. However, the transmission lines 106*a*, 106*b* may be routed into the central bore 110 of the downhole tools 100*a*, 100*b* where the wall thickness is lesser.

To transmit data across the tool joint, transmission elements 110*a*, 110*b* may be incorporated into the pin end 102 and box end 104 respectively. For example, where the drill pipe is "double shouldered" drill pipe, as illustrated, a pair of transmission elements may be incorporated into recesses in the secondary shoulders 112*a*, 112*b* of the pin end 102 and box end 104 (as opposed to the primary shoulders 114*a*, 114*b*). These transmission elements 110*a*, 110*b* may communicate using any known method. For example, the transmission elements 111*a*, 110*b* may use direct electrical contacts or inductive coupling to transmit data signals across the tool joint. Additional details regarding the drill pipe that may be used to implement aspects of the invention may be found in U.S. Pat. Nos. 6,670,880, 7,139,218 and 6,717,501, all incorporated herein by reference in their entirety and assigned to the present assignee.

Although the downhole tools 100*a*, 100*b* illustrated in FIG. 1 are sections of drill pipe, the downhole tools 100*a*, 100*b* may include any number of downhole tools, including but not limited to heavyweight drill pipe, drill collar, crossovers, mud motors, directional drilling equipment, stabilizers, hole openers, sub-assemblies, under-reamers, drilling jars, drilling shock absorbers, and other specialized devices, which are all well known in the drilling industry.

Figure 2:
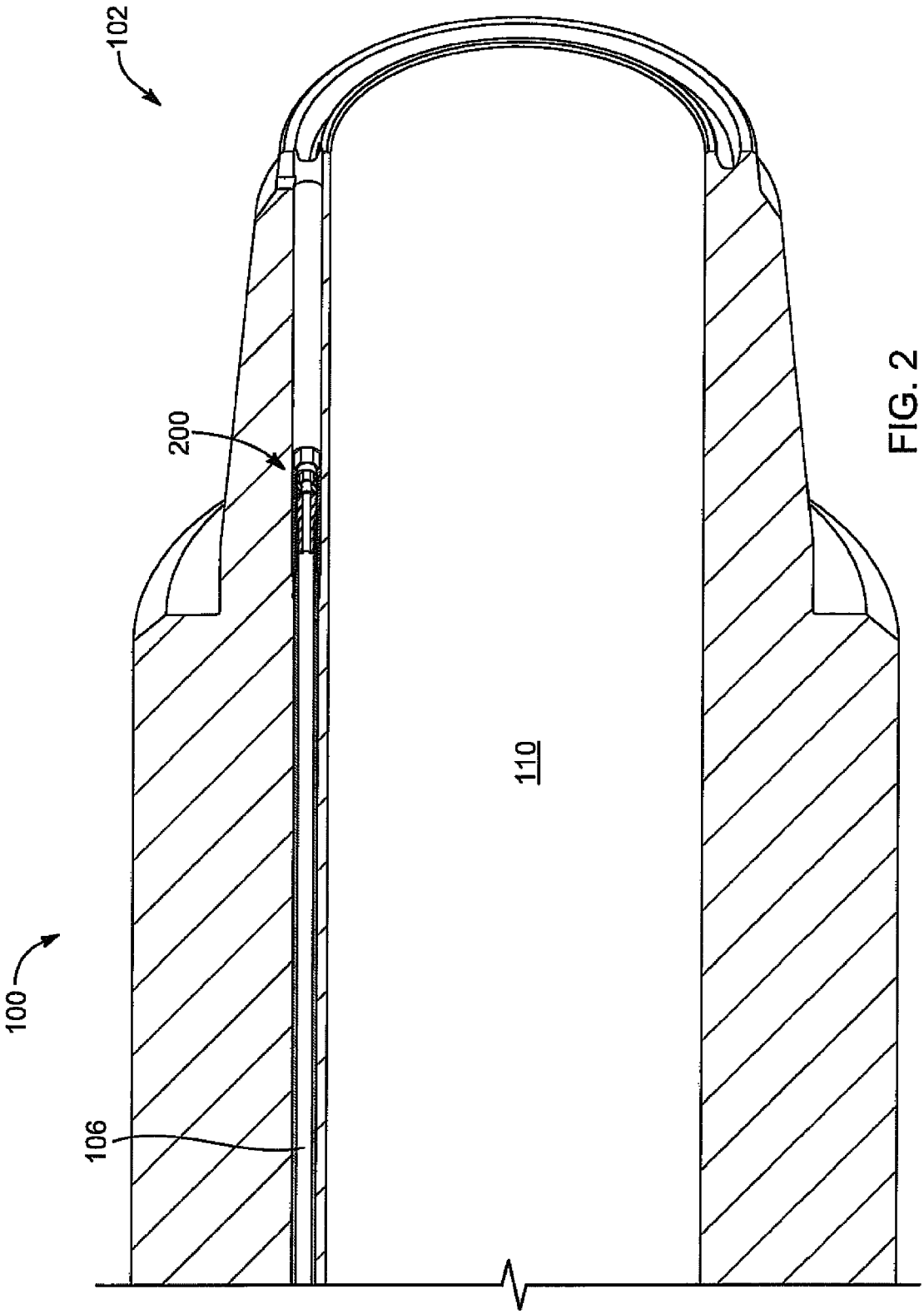
FIG. 2 is a cross-sectional perspective view of one embodiment of a threaded retention device incorporated into the pin end of a downhole tool.

Referring to FIG. 2, as previously mentioned, one potential problem with routing transmission lines 106 through downhole tools 100 is that the transmission lines 106 may interfere with tools, fluids, or debris moving through the central bore 110. These tools, fluids, or debris may sever or damage the transmission lines 106, thereby terminating or interrupting the flow of data along the drill string. Thus, apparatus and methods are needed to route transmission lines 106 through downhole tools 100 in a safe and reliable manner. Ideally, such apparatus and methods would be able to maintain tension in the transmission lines 106 to minimize movement within the central bore 110 and minimize interference with tools or other debris moving therethrough. Ideally, such apparatus and methods would enable quick and inexpensive installation of downhole transmission lines 106 in downhole tools 100 without the need for expensive equipment or highly trained personnel.

FIG. 2 shows one embodiment of a retention device 200 in accordance with the invention. In this embodiment, the retention device 200 is incorporated into the pin end 102 of a downhole tool 100, although an equivalent device may also be incorporated into the box end 104 of a downhole tool 100. The retention device 200 is able to maintain tension in a transmission line 106, in this example a transmission line 106, in order to minimize movement within the central bore 110 and minimize interference with tools and/or debris traveling through the central bore 110. The retention device 200 also enables a transmission line 106 to be quickly and easily installed in a downhole tool 100 without the need for expensive tools or equipment.

Figure 3:
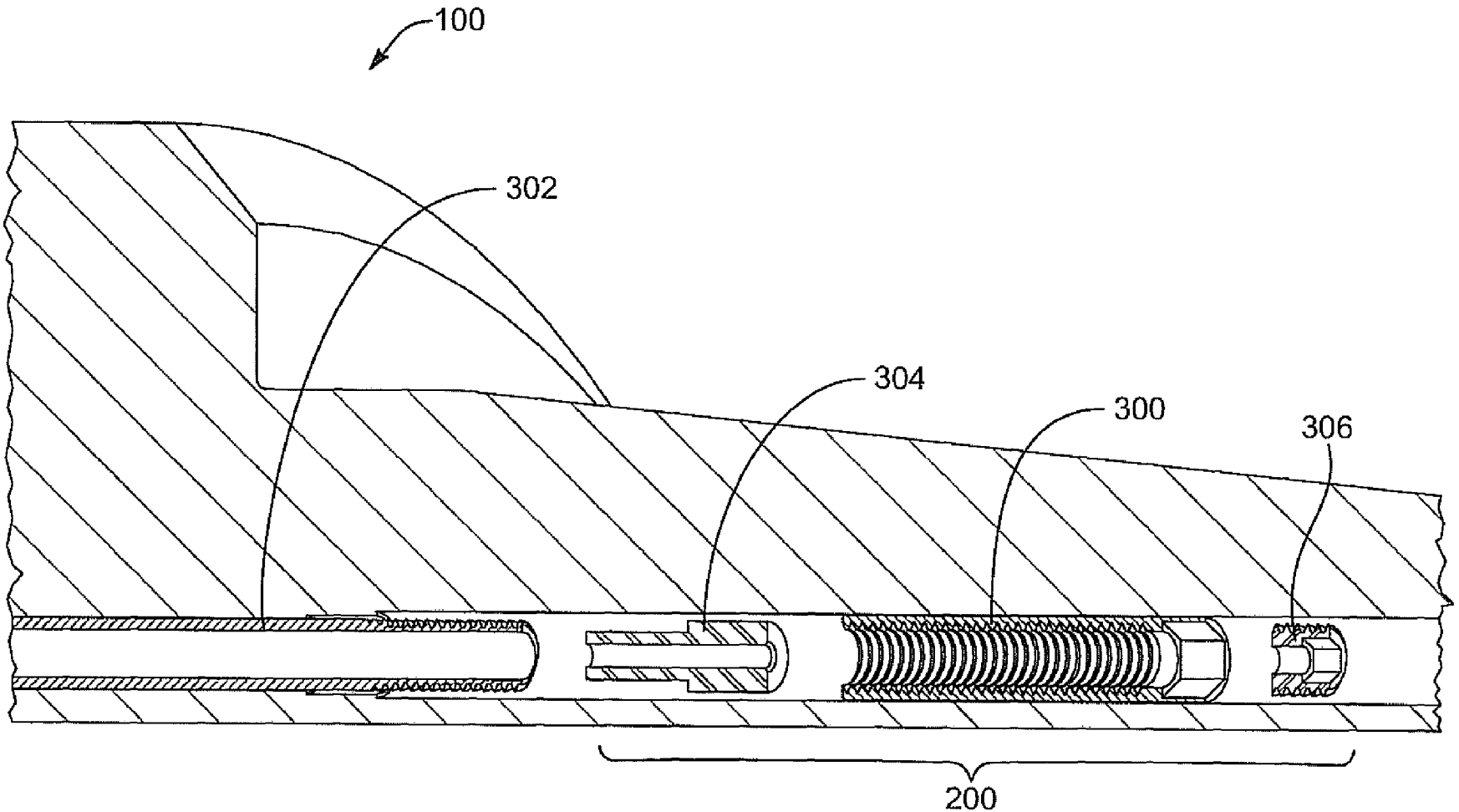
FIG. 3 is an exploded cross-sectional perspective view of the threaded retention device of FIG. 2.

FIG. 3 is an exploded cross-sectional perspective view of one embodiment of a threaded retention device 200 in accordance with the invention. As shown, in selected embodiments, the retention device 200 may include a nut element 300, a seal member 304, and a screw piece 306. The nut element 300 may include internal threads along an inside diameter thereof to engage externally threaded tubing 302. In some aspects, the tubing 302 may be configured to provide 'armor' for the transmission line 106. Similarly, the screw piece 306 may include external threads along an outside diameter thereof, allowing it to be threaded into the inside diameter of the nut element 300. Both the nut element 300 and the screw piece 306 may include a socket, such as a hex socket, incorporated into an end thereof to allow a tool, such as a hex key, to apply torque to the nut element 300 and the screw piece 306 respectively.

Each of the nut element 300, seal member 304, screw piece 306, and tubing 302 may include a passageway to allow a transmission line 106 (not shown) to pass therethrough. The transmission line 106 may include coaxial cable, electrical wires, optical fibers, or other conductors or cables capable of transmitting power and/or a signal. Similarly, the tubing 302, nut element 300, and screw piece 306 may be fabricated from materials such as steel (e.g., stainless steel), aluminum, titanium, or other suitable materials.

Figure 4:
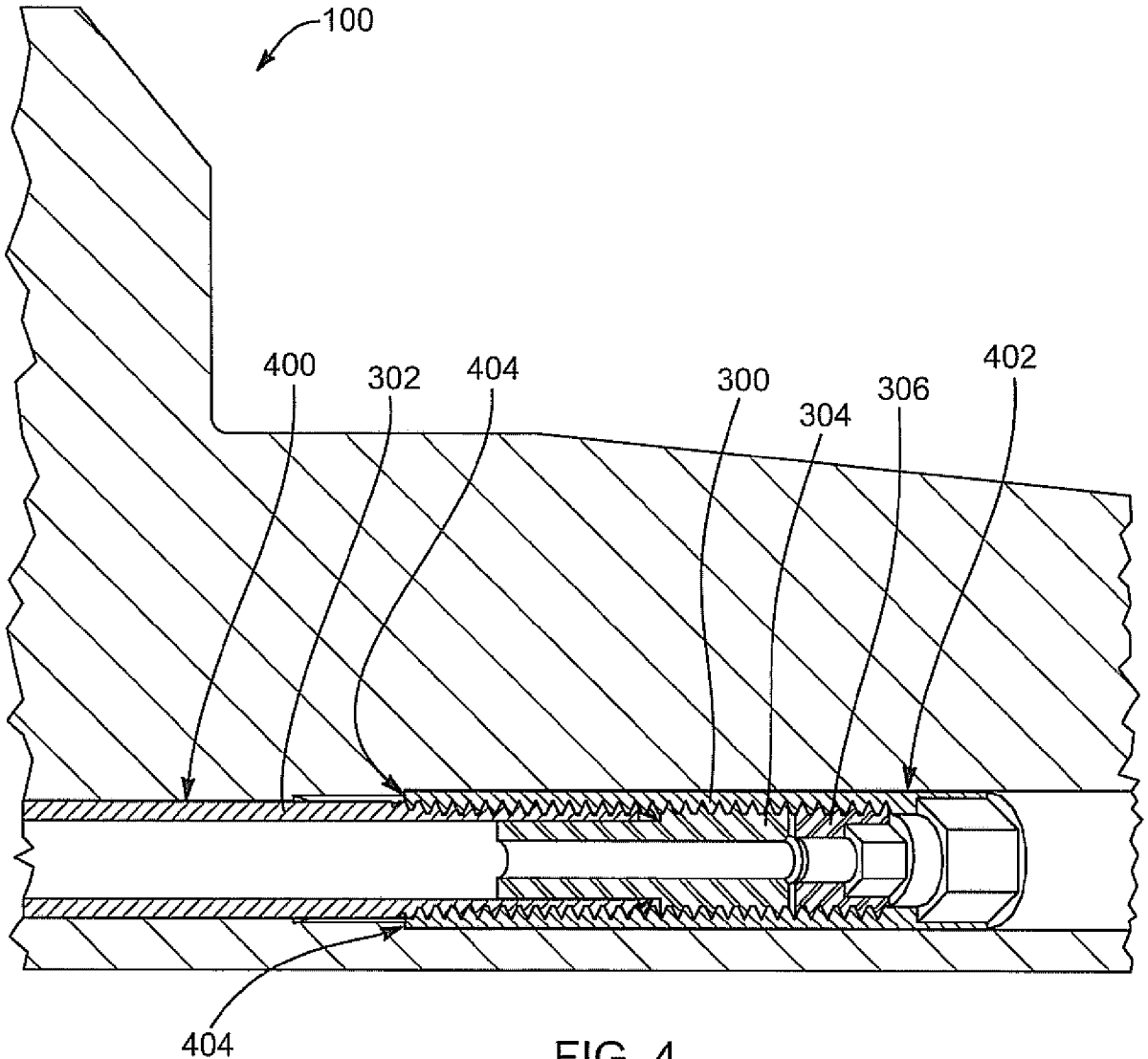
FIG. 4 is an assembled cross-sectional perspective view of the threaded retention device of FIG. 2.

Referring to FIG. 4, to retain the end of the threaded tubing 302, the seal member 304 may be inserted into the inside diameter of the tubing 302 and the nut element 300 may be threaded onto the tubing 302. In selected embodiments, the nut element 300, seal member 304, and screw piece 306 may be pre-assembled as a single unit that may be threaded onto the end of the tubing 302. In certain aspects, the seal member 304 may be fabricated from an elastomer (e.g., Viton or other fluoropolymer elastomer) or other suitable material, and be substantially cylindrical in shape. The outside diameter of the seal member 304 may include a first portion that roughly conforms to the inside diameter of the tubing 302 and a second portion that roughly conforms to the inside diameter of the nut element 300. This will prevent water or other fluids from passing through the threaded connection. The inside diameter of the seal member 304 may be selected to create a seal with the cable or conductor passing therethrough. This will create a seal between the inside diameter of the tubing 302 and the outside diameter of the cable or conductor.

The screw piece 306 may be used to compress the seal member 304 and thereby improve the seal it makes with surrounding elements. That is, as the screw piece 306 is threaded into the nut element 300 towards the seal member 304, the outside diameter of the seal member 304 will expand to create a more robust seal with the inside diameter of the tubing 302 and the inside diameter of the nut element 300. The seal member 304 may also compress around the transmission line 106 that passes therethrough.

In certain embodiments, the outside diameter of the tubing 302 may be designed to fit snugly within the inside diameter of a hole 400 (e.g., a gun-drilled hole 400) of the downhole tool 100. Similarly, the outside diameter of the nut element 300 may be designed to fit snugly within the inside diameter of an enlarged hole 402 (i.e., a gun-drilled counterbore 402) of the downhole tool 100. The nut element 300 may abut against an edge 404 of the counterbore 402, thereby enabling the nut element 300 to retain and maintain tension in the transmission line 106.

Figure 5A:
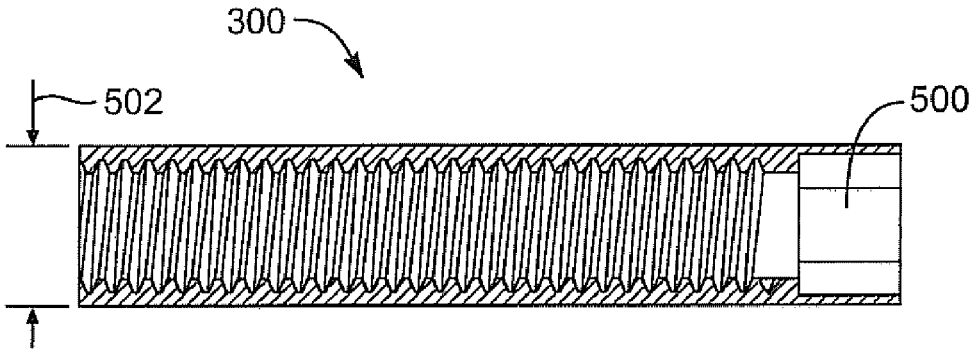
FIG. 5A is a cross-sectional side view of one embodiment of a nut element in accordance with the invention.
Figure 5B:
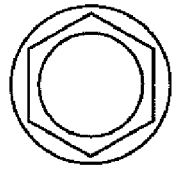
FIG. 5B is an end view of the nut element of FIG. 5A.

FIG. 5A is a cross-sectional side view of one embodiment of a nut element 300 in accordance with the invention. As shown, in certain embodiments, the nut element 300 may be an elongate structure with a substantially cylindrical outside diameter and a threaded inside diameter. The threaded inside diameter is designed to engage the externally threaded transmission line 106 and the threaded screw piece 306. In selected embodiments, a fine thread series (e.g., UNRF) or extra fine thread series (e.g., UNREF) may be used to provide greater thread contact area. The fine thread series are able to withstand higher tensile loads and are suitable in applications where the wall thickness 502 is limited. A socket 500, such as a hex socket 500, may be incorporated into one end of the nut element 300 to allow a tool to apply torque thereto. FIG. 5B shows an end view of the nut element 300 of FIG. 5A.

Figure 6A:
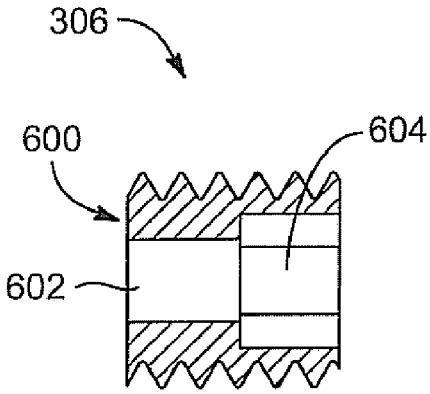
FIG. 6A is a cross-sectional side view of one embodiment of a screw piece in accordance with the invention.
Figure 6B:
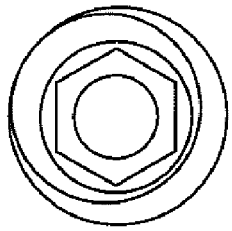
FIG. 6B is an end view of the screw piece of FIG. 6A.

FIG. 6A is a cross-sectional side view of one embodiment of a screw piece 306 in accordance with the invention. As shown, in certain embodiments, the screw piece 306 may be "headless," thereby allowing it to be threaded into the nut element 300 a desired distance. The screw piece 306 may be tightened, as needed, to provide a variable amount of compression on the seal member 304. A face 600 may have sufficient surface area so that it can compress the seal member 304 while avoiding significant extrusion through the inside diameter 602. Like the nut element 300, a socket 604, such as a hex socket 604, may be incorporated into one end of the screw piece 306. FIG. 6B is an end view of the screw piece of FIG. 6A.

Figure 7A:
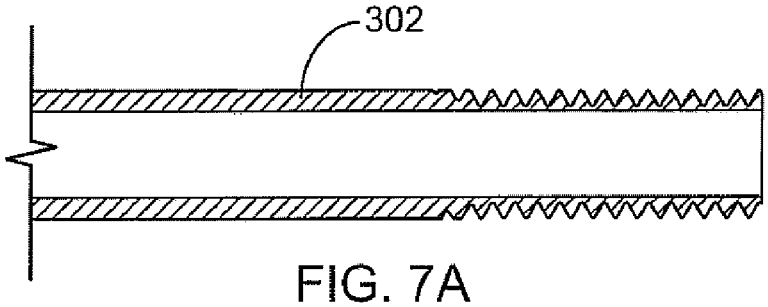
FIG. 7A is a cross-sectional side view of one embodiment of threaded tubing for a transmission line in accordance with the invention.
Figure 7B:
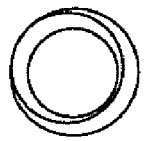
FIG. 7B is an end view of the threaded tubing of FIG. 7A.

FIG. 7A is a cross-sectional side view of one embodiment of threaded tubing 302 for a transmission line 106 in accordance with the invention. The tubing 302 may be made of stainless steel or other suitable materials. Depending on the wall thickness, the tubing 302 may require a fine thread series or extra fine thread series. The inside diameter of the tubing 302 may be designed to allow a transmission line to pass therethrough. FIG. 7B is an end view of the threaded tubing 302 of FIG. 7A.

Figure 8:
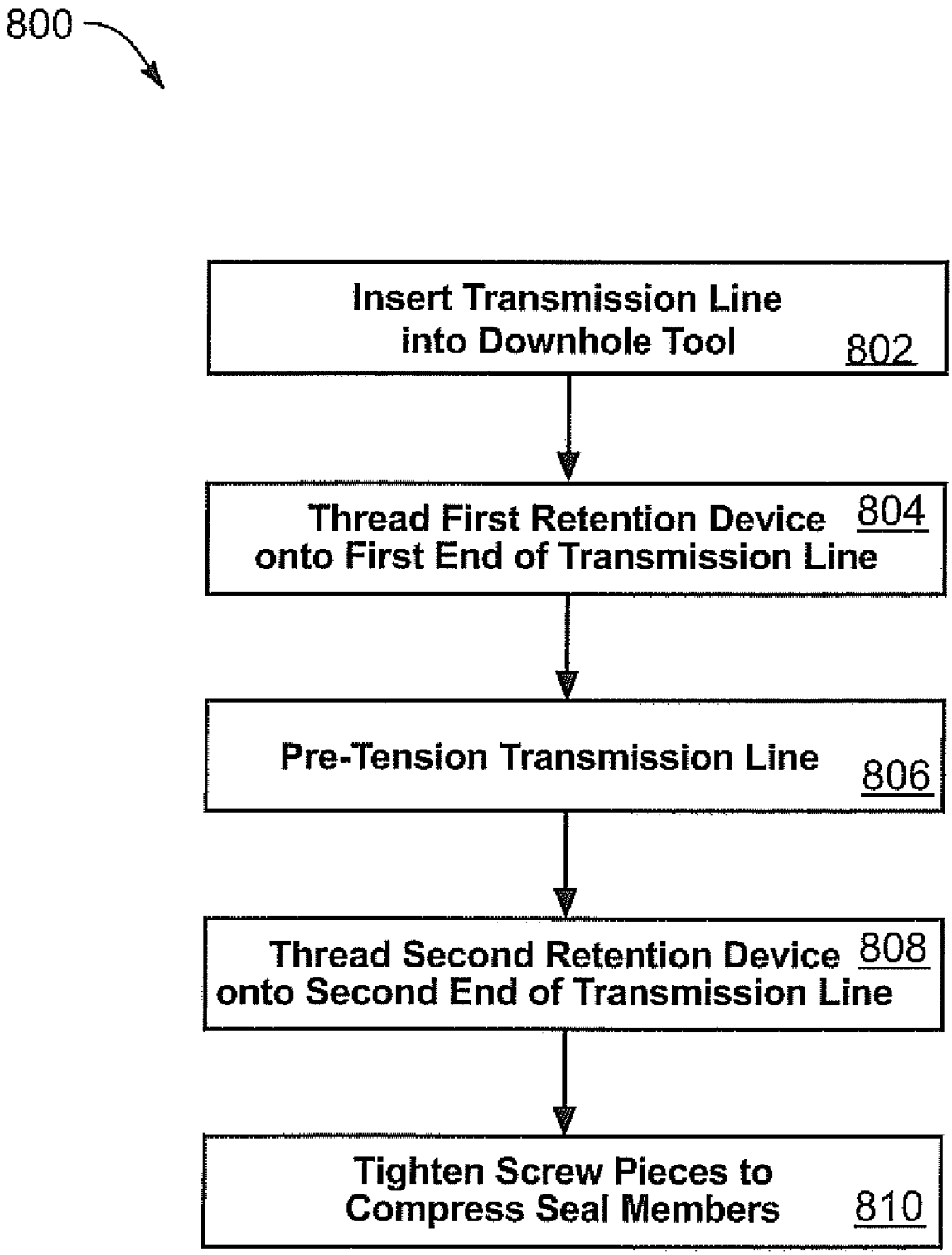
FIG. 8 is a flow chart of one embodiment of a method for retaining and/or tensioning a transmission line using threaded retention devices in accordance with the invention.

FIG. 8 shows one embodiment of a method 800 for installing a transmission line 106 in a downhole tool 100. In selected embodiments, such a method 800 may include initially inserting 802 a transmission line 106 into a downhole tool 100. This may include routing the transmission line 106 through the gun-drilled hole of a first end of the downhole tool 100, through the internal bore 110, and through the gun-drilled hole of a second end of the downhole tool 100. Other aspects of the invention may be implemented with the transmission line 106 disposed on the downhole tool 108 using harnesses, combined internal/external line routing, and other suitable means (not shown). The method 800 may then include threading 804 a first retention device 200 onto a first end of the transmission line 106 using an Allen wrench or other suitable tool. In certain cases, the retention device 200 may come pre-assembled with the seal member 304 and screw piece 306 installed. Because the transmission line 106 is not under tension at this point, applying the first retention device 200 to the transmission line 106 may be a relatively simple procedure.

Once the first retention device 200 is threaded onto the first end of the transmission line 106, the transmission line 106 may be placed 806 under tension (e.g., 200 to 1200 lbs. of tension) with a tensioning tool. This may allow a second retention device 200 to be threaded 806 onto the second end of the transmission line 106. This may be accomplished by inserting the second retention device 200 into the gun-drilled hole and threading 808 it onto the end of the transmission line 106 using an Allen wrench or other tool. The tensioning tool may then release the transmission line 106. At this point, the retention devices 200 will retain the ends of the transmission line 106 and maintain tension therein. If desired, a locking thread compound may be applied to the threads of the retention devices 200 before they are threaded onto the transmission line 106, thereby preventing them from loosening. At this point, the screw pieces 306 may be tightened 810 to compress the seal members 304, thereby sealing the joints between the transmission line 106 and the nut elements 300.

The present invention may be embodied in other specific forms without departing from the essential characteristics disclosed herein. The described aspects are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for retaining and tensioning an end of a transmission line, the apparatus comprising:

a tubing having a throughbore to accommodate passage of a transmission line therethrough;

a nut element threadedly coupled to the tubing and having a passageway to receive the transmission line therethrough, the nut element comprising internal threads extending along at least a portion of the length of the passageway;

an elastomeric seal member for insertion into the passageway; and a screw piece to thread into the internal threads of the passageway and thereby compress the elastomeric seal.

2. The apparatus of claim 1, wherein an outer surface of the nut element is substantially cylindrical.

3. The apparatus of claim 2, wherein an outer surface of the tubing is substantially cylindrical.

4. The apparatus of claim 2, wherein an outer diameter of the cylindrical outer surface is substantially uniform along a length thereof.

5. The apparatus of claim 1, wherein the compressed elastomeric seal member creates a robust seal between the transmission line and the nut element.

6. The apparatus of claim 1, wherein the compressed elastomeric seal member creates a robust seal between the transmission line and the tubing.

7. The apparatus of claim 1, wherein the screw piece comprises a socket to enable a tool to apply torque thereto.

8. The apparatus of claim 1, wherein the transmission line is a coaxial cable.

9. The apparatus of claim 1, wherein the nut element comprises a socket configured to receive a tool for rotating the nut element.

10. An apparatus comprising:

a downhole tool;

a transmission line extending through a central bore of the downhole tool, the transmission line disposed within a tubing, the tubing having external threads on an end thereof; and a retention device for securing the tubing proximate an end of the downhole tool, the retention device comprising:

a nut element comprising internal threads configured to engage the external threads of the tubing and abut against a feature of the downhole tool, thereby retaining the end of the tubing, the internal threads further forming a passageway extending from a first end to a second end of the nut element, the passageway allowing the transmission cable to pass through the nut element;

an elastomeric seal member for insertion into the passageway; and a screw piece to thread into the internal threads of the passageway and thereby compress the elastomeric seal.

11. The apparatus of claim 10, wherein the nut element further comprises a socket incorporated into one of the first and second ends to enable a tool to apply torque to the nut element.

12. The apparatus of claim 10, wherein an outer surface of the nut element is substantially cylindrical.

13. The apparatus of claim 12, wherein an outer surface of the transmission line is substantially cylindrical.

14. The apparatus of claim 13, wherein an outer diameter of the nut element is substantially larger than an outer diameter of the tubing.

15. The apparatus of claim 10, wherein the internal threads extend at least a portion of the length of the passageway.

16. The apparatus of claim 10, wherein the compressed elastomeric seal member creates a robust seal between the transmission line and the nut element.

17. The apparatus of claim 10, wherein the compressed elastomeric seal member creates a robust seal between the transmission line and the tubing.

18. The apparatus of claim 10, wherein the screw piece comprises a socket to enable a tool to apply torque thereto.

19. The apparatus of claim 10, wherein the transmission line is coaxial cable.

20. A method for securing a transmission line proximate an end of a downhole tool, the method comprising:

routing a transmission line through a central bore of a downhole tool, the transmission line disposed within a tubing, the tubing comprising external threads on an end thereof; and securing the tubing proximate an end of the downhole tool, wherein securing comprises:

threading an internally threaded nut element over the external threads of the tubing, the internal threads forming a passageway extending from a first end to a second end of the nut element, the passageway allowing the transmission line to pass through the nut element;

inserting an elastomeric seal member into the passageway; and threading a screw piece into the internal threads of the passageway to compress the elastomeric seal.

21. The method of claim 20, wherein threading the internally threaded nut element comprises applying torque to a socket incorporated into an end of the nut element.

22. The method of claim 20, wherein compressing the elastomeric seal member comprises creating a more robust seal between the transmission line and the nut element.

23. The method of claim 20, wherein compressing the elastomeric seal member comprises creating a more robust seal between the transmission line and the tubing.

* * * * *